United States Patent [19]

Friedman

[11] 4,406,043

[45] Sep. 27, 1983

[54] BELT BUCKLE CONSTRUCTION

[75] Inventor: Harvey W. Friedman, Longmeadow, Mass.

[73] Assignee: Buxton, Inc., Agawam, Mass.

[21] Appl. No.: 433,708

[22] Filed: Oct. 12, 1982

[51] Int. Cl.[3] ..... A44B 11/10

[52] U.S. Cl. ..... 24/171; 24/182; 24/265 EC

[58] Field of Search ..... 24/194, 181, 171, 195, 24/196, 265 BC, 265 EC, 182

[56] References Cited

U.S. PATENT DOCUMENTS

| | | | |
|---|---|---|---|
| 56,590 | 7/1866 | McLellan | 24/171 |
| 312,679 | 2/1885 | Wagner | 24/182 |
| 1,352,937 | 9/1920 | Berrs | 24/194 |
| 1,368,848 | 2/1921 | Shufeldt | 24/171 |
| 1,763,100 | 6/1930 | Mendosh | 24/265 BC |
| 1,775,137 | 9/1930 | Ostrower | 24/182 |
| 1,969,582 | 8/1934 | Rosenblum | 24/182 |
| 2,219,756 | 10/1940 | Sokolof | 24/265 BC |
| 2,569,750 | 10/1951 | Dillenz | 24/194 |
| 3,226,786 | 1/1966 | Burdorf et al. | 24/171 |
| 4,281,440 | 8/1981 | Britz | 24/182 |

FOREIGN PATENT DOCUMENTS

| | | | |
|---|---|---|---|
| 279651 | 11/1914 | Fed. Rep. of Germany | 24/194 |
| 197810 | 10/1978 | France | 24/265 BC |

*Primary Examiner*—Paul J. Hirsch

*Attorney, Agent, or Firm*—Chapin, Neal & Dempsey

[57] ABSTRACT

A belt buckle construction is disclosed which has a keeper with a frame and tongue pivotably disposed on the outer end thereof for interengagement with the longitudinally perforated end of a flexible belt strap. The keeper also includes a rearwardly opening sleeve to receive the inner end of the belt strap, which may be of the reversible type. The sleeve includes an upwardly opening undercut slot which exposes a surface portion of the inner end of the belt strap. A combination belt loop and belt clamping member transversely engageable within said slot and including a projecting portion for engaging and releasably clamping the inner end of said belt within the sleeve of said keeper. This construction enables the belt to be cut to any desired length and/or reversed from one side to the other. The belt loop portion of said clamping member serves to receive and retain the outer end of the belt flat against the underlying end of the belt for a neat appearance.

6 Claims, 4 Drawing Figures

BELT BUCKLE CONSTRUCTION

BACKGROUND OF THE INVENTION

Belt buckles have been available for many years with various types of clamping mechanisms to engage and disengage the inner end of a belt strap for either adjusting the length of the belt or for use with reversible belts which may be worn so that either side is visible. The 1885 patent to Wagner U.S. Pat. No. 312,679 discloses a belt clamp and loop device in which the belt clamp includes a plurality of teeth or studs which engage holes provided a short distance from the inner ends of the belt strap to receive the studs. The 1940 U.S. Pat. No. 2,219,756 discloses another mechanism for clamping the end of the belt which takes the form of a pivotable clamping member having teeth at its inner edge. U.S. Pat. No. 2,569,750 discloses a wedge-shaped locking element disposed to clamp the outer end portion of the belt strap within the buckle, and U.S. Pat. No. 4,281,440 discloses a pivotable toothed clamping member for engaging the inner end of the belt within the belt frame. While the above cited patents show various types of mechanisms for clamping the inner end of the belt within the buckle frame or keeper, the mechanisms disclosed are, in general, relatively complex in that they involve a pivotable clamping lever, or as in the case of the Wagner Patent, studs are provided to cooperate with perforations provided in the belt, and the studs must be carefully aligned and inserted for assembly. Alternatively, a panel may be used to strike the clamping member and compress it tightly into the overlapped end portion of the belt strap.

It is the principal object of this invention to provide a belt buckle of simple and economical construction and of attractive appearance which may be quickly, easily and securely attached and released from the belt strap.

It is another object of this invention to provide a belt buckle construction of the above type which lends itself to use on reversible belt straps and belt straps of maximum lengths which may be individually cut to each customer's size for retail sale.

It is another object of this invention to provide a belt buckle construction of the above type which is not only easy to use, but effective and reliable in its operation.

It is yet a further object of this invention to provide a universal belt buckle construction for convenient point of sale assembly with any of a variety of belt straps adapted to be cut to length for each customer's waist size and assembled with a belt buckle of the above type.

The above and other objects and advantages of this invention will be more readily apparent from the following description and with reference to the accompanying drawings, in which.

Figure 1:
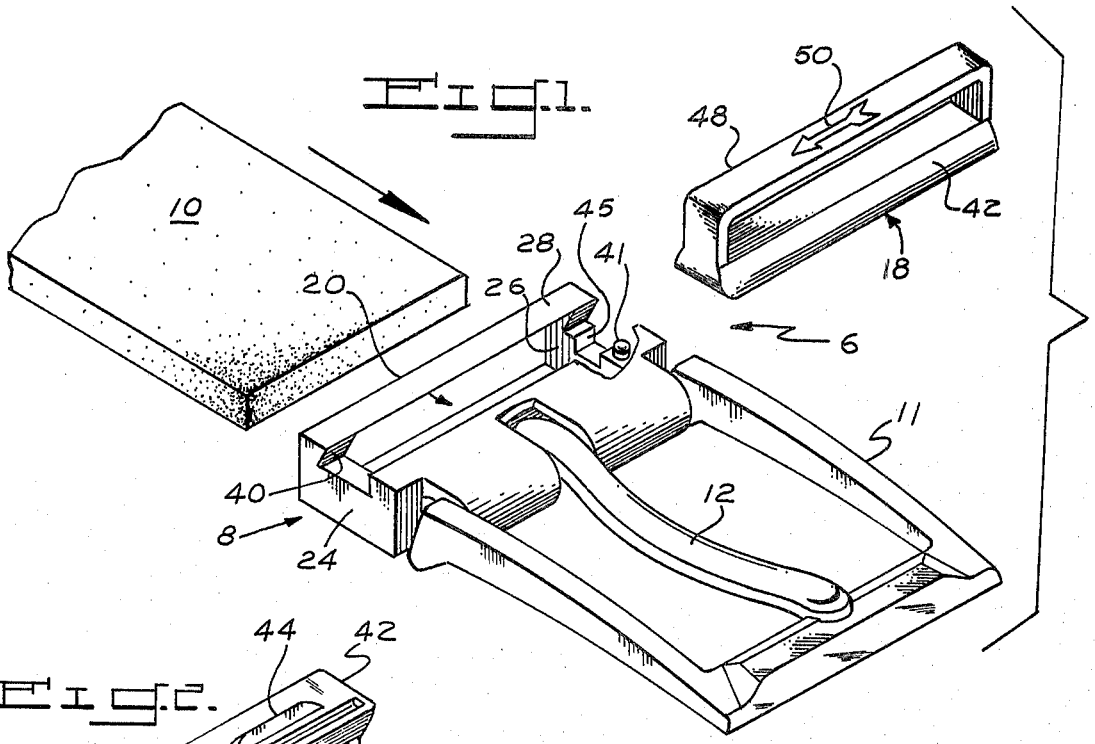
FIG. 1 is a perspective view of a belt buckle of the type embodying this invention in disassembled condition.

Referring in detail to the drawing, a belt buckle is illustrated in FIG. 1 generally at 6. The inner end of the buckle 6 comprises a keeper portion 8 adapted to receive the inner end of a flexible belt strap 10. An open frame 11 of rectangular or other suitable configuration is pivotably disposed on the outer or forward end portion of the keeper 8. A tongue 12 is also pivotably disposed at the forward end of the keeper and its outer end is adapted to fit through one of the longitudinally spaced perforations or holes at the outer end of the belt strap 10 as illustrated at 13 in FIG. 3 of the drawing. The belt 10 may be a conventional, flexible belt strap of leather or other suitable material having an overall length of the maximum waist size ordinarily carried in retail stores. The belt strap may be fitted about the waist of each individual customer and cut at its inner end to the precise length desired. The cut end of the strap 10 is then fitted into the keeper portion of the buckle and clamped in place by using a combination clamping member and belt loop as illustrated at 18 in FIG. 1, as will hereafter be more fully described.

Figure 3:
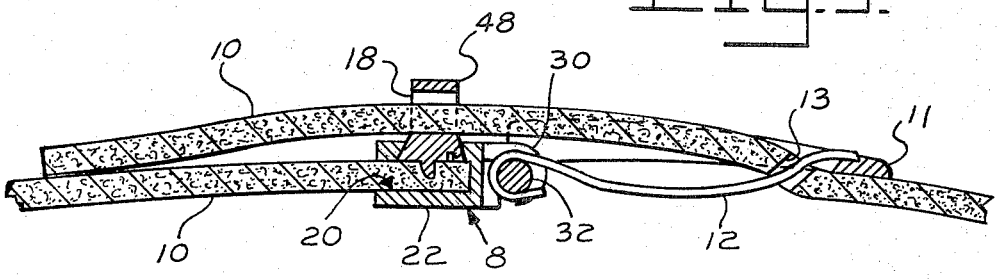
FIG. 3 is a cross sectional view of the buckle with a belt strap in assembled relation and with the belt strap in closed condition.
Figure 4:
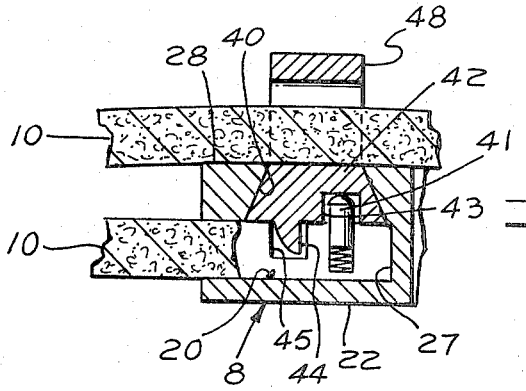
FIG. 4 is an enlarged cross sectional view illustrative of the belt clamping function of the buckle.

The keeper portion 8 of the belt buckle 6 comprises a generally rectangular rearwardly opening chamber 20 best illustrated in FIGS. 3 and 4. The keeper comprises a base portion 22, upwardly extending end walls 24 and 26, front wall 27 and a top wall 28. A hinge leaf 30 extends outwardly and curves downwardly from the upper forward edge of the keeper 8 and is adapted to pivotably receive a cross rod 32 of the belt buckle frame 11. The hinge leaf 30 includes a cut-out 34 which accommodates the inner end portion of the buckle tongue 12, which is reversibly looped about the pivot pin 32 of the belt buckle frame 11. The tongue is thus independently pivotable on the pivot pin 32 and the belt buckle frame 11 is itself pivotable about its pin 32 which is disposed within the hinge leaf 30.

The top wall 28 of the keeper includes an undercut slot 40, adapted to receive therein the base portion 42 of the clamping member 18. The edges of slot 40 are of tapered construction, flaring outwardly from its upper to its lower end, as best illustrated in FIG. 4. The base portion 42 of the clamping member is of similarly tapered configuration, so as to fit easily into the slot 40 for sliding movement from one side to the other of the keeper. In the illustrated embodiment in FIG. 1, the clamping member 18 may be fitted from the right side of the buckle and moved toward the left side with the base portion fitted into the undercut slot 40.

The side wall 26 of the keeper includes a U-shaped notch 45 opening from the bottom edge of the slot 40. The notch 45 is adapted to register with the ribs 44 on the lower surface of the clamping member 42. Preferably, the ribs 44 are disposed closer to one side edge of the base 42 and register with entry notch 45 only when the member 18 is fitted into the slot 40 in the proper direction. An arrow 50 may be embossed or otherwise applied on to the upper surface of the member 18 to facilitate one correct assembly technique. Preferably, however, the clamping member may be adapted to be retained in assembled relation within the keeper 8 by means of a spring-loaded retainer pin 41 which extends from the bottom of the slot 40. The outer end of the pin 40 is received within a groove 43 which extends transversely of the lower surface of the base portion 42 of the clamping member 18. This arrangement is best shown in FIG. 4 and it will be recognized that other suitable means may be used to retain the clamping member in assembled relation with the buckle. For example, after assembly, the inner end portion of the keeper could be struck or peened to prevent removal of the member 18 from the slot 40.

Figure 2:
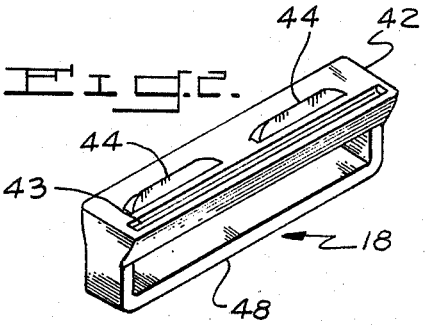
FIG. 2 is a bottom perspective view of one component of the buckle of FIG. 1.

As illustrated in FIG. 2, the underside of the base portion 42 includes projecting means in the form of a pair of spaced ribs 44, which extend outwardly from the bottom surface of the base 42 of the clamping member. The ribs 44 serve to clampingly engage the upper surface of the inner end of the belt strap 10, as best illustrated in FIG. 3, and thereby lock the buckle and strap together. A generally rectangular loop portion 48 extends in spaced relation across the upper surface of base 42 from one end to the other end thereof and provides means for holding the outer end of the belt strap 10 against the outer surface of the inner end of the strap, thus providing a neat appearance on the wearer as illustrated in FIG. 3 of the drawings.

The buckle 6 embodying this invention is ideally adapted to be marketed for custom fitting with a belt strap selected by the retail customer. The belt straps and buckles may be individually selected, and the belt strap cut to fit the waist size of the customer. The buckle may also be separately selected and may be provided in a variety of finishes, e.g., gold, silver, copper, black, two tone, etc. After the belt strap 10 is cut to length, the squared end of the strap is fitted into the rearwardly facing chamber 20 of the buckle keeper 8, the clamping member 18 having been first removed from the transverse slot 40. Thereupon, the base 42 of member 18 having been fitted into the undercut slot 40 is pushed transversely into the slot 40 until its outer ends are aligned flush with the outer end walls 24 and 27 of the keeper. In doing this, the ribs 44 automatically wedge into and depress the leather or other material of the belt strap and clamp it firmly and securely within the keepers of the buckle.

If desirable, the belt 10 may be of the reversible or double sided type, such as brown on one side and black on the other. To reverse the belt strap from one side to the other is a simple matter of laterally retracting the clamping member 18. The belt strap may then be removed, reversed and reinserted into the keeper chamber 20 and the clamp member 18 refitted into the slot 40.

It will thus be recognized that the belt buckle embodying this invention, while extremely versatile, is simple to use. In addition, although of simple and economical construction, the buckle is highly effective in operation and presents a most attractive and functional appearance.

Having disclosed this invention, what is claimed is:

1. Belt buckle construction comprising a frame and a keeper pivotably interconnected, the keeper including a rearwardly opening chamber adapted to receive therein the inner terminal end of a belt strap, a transversely extending slot opening through said chamber to expose a portion of the upper surface of said belt strap disposed in said chamber, a belt clamping member adapted to be slidably fitted transversely into said slot, and including a projecting portion on the inner surface thereof for clamping engagement with the exposed portion of the belt strap to lock one end of the strap and buckle together.

2. Belt buckle construction as set forth in claim 1 wherein said clamping member includes a belt loop in its outer surface for receiving therethrough the outer end of said belt strap to hold the same in parallel relation to the inner end portion of the strap.

3. Belt buckle construction as set forth in claim 2 wherein the keeper includes a hinge leaf which extends forwardly of the end of said keeper opposite the chamber opening, said hinge leaf having a curved configuration and said frame having a transverse pivot pin pivotably disposed within said hinge leaf of the keeper, said hinge leaf including a cut-out for pivotable connection of the inner end of a buckle tongue onto the pivot pin of said frame.

4. Belt buckle construction as set forth in claim 2 wherein the projecting portion of the inner surface of the clamping member comprise at least one laterally extending upstanding rib, said rearwardly opening chamber including sidewalls undercut to form a transverse slot in the keeper to receive a similarly shaped base portion of the belt clamping member, one of the side walls of said chamber further including a notch which permits slidable movement of the projecting rib therethrough whereby said clamping member is insertable and removable through one of the side walls of said keeper.

5. Belt buckle construction as set forth in claim 4 wherein means is provided for retaining said clamping member in assembled relation for lateral slidable movement within the transverse slot of said keeper.

6. Belt buckle construction as set forth in claim 5 in which said retaining means comprises a spring pin disposed within a transverse groove formed in said clamping member.

* * * * *